US009956135B2

(12) United States Patent
Stemple

(10) Patent No.: US 9,956,135 B2
(45) Date of Patent: May 1, 2018

(54) APPLIANCE FOR CARDIOPULMONARY MASSAGE AND/OR RESUSCITATION

(71) Applicant: GS ELEKTROMEDIZINISCHE GERÄTE G. STEMPLE GMBH, Kaufering (DE)

(72) Inventor: Gunter Stemple, Kaufering (DE)

(73) Assignee: GS Elektromedizinische Geräte G. Stemple GmbH

( * ) Notice: Subject to any disclaimer, the term of this patent is extended or adjusted under 35 U.S.C. 154(b) by 390 days.

(21) Appl. No.: 14/762,673

(22) PCT Filed: Jan. 29, 2014

(86) PCT No.: PCT/IB2014/058639
§ 371 (c)(1),
(2) Date: Jul. 22, 2015

(87) PCT Pub. No.: WO2014/118715
PCT Pub. Date: Aug. 7, 2014

(65) Prior Publication Data

US 2015/0366751 A1 Dec. 24, 2015

(30) Foreign Application Priority Data

Jan. 30, 2013 (DE) ..... 10 2013 100 943

(51) Int. Cl.
*A63B 24/00* (2006.01)
*A61H 31/00* (2006.01)

(52) U.S. Cl.
CPC ..... *A61H 31/006* (2013.01); *A61H 31/005* (2013.01); *A61H 2031/002* (2013.01);
(Continued)

(58) Field of Classification Search
CPC ..... A61H 31/006; A61H 31/005; A61H 2031/002; A61H 2201/0192;
(Continued)

(56) References Cited

U.S. PATENT DOCUMENTS 4,082,090 A 4/1978 Harrigan
4,273,114 A * 6/1981 Barkalow ..... A61H 31/005 601/106

(Continued)

FOREIGN PATENT DOCUMENTS

DE 197 04 032 8/1998
JP H07-049325 2/1995

(Continued)

OTHER PUBLICATIONS

International Search Report for PCT/IB2014/058639 dated Apr. 23, 2014.

*Primary Examiner* — Glenn Richman
(74) *Attorney, Agent, or Firm* — Fay Sharpe LLP

(57) ABSTRACT

The appliance according to the invention serves for cardiopulmonary massage and/or resuscitation of a patient and is provided with a massage device (17) which can be driven reversibly by a drive device (18) in an actuation direction (23) and which has a pressure area (20) that can be positioned on the chest (12) of a patient (11) at a target contact area (21). In order to ensure that deviations of the pressure area of the massage device from a target pressure point can be determined promptly and reliably, the invention proposes a position sensor device (22), for determining changes in the position of the massage device (17) and/or of the pressure area (20) thereof relative to the target contact area (21) on the chest (12) of the patient in a plane normal to the actuation direction (23) of the massage device (17).

9 Claims, 5 Drawing Sheets

(52) U.S. Cl.
CPC ..... *A61H 2201/0176* (2013.01); *A61H 2201/0184* (2013.01); *A61H 2201/0192* (2013.01); *A61H 2201/1664* (2013.01); *A61H 2201/5007* (2013.01); *A61H 2201/5064* (2013.01); *A61H 2201/5097* (2013.01)

(58) Field of Classification Search
CPC .... A61H 2201/1664; A61H 2201/5007; A61H 2201/5064; A61H 2201/5097; A61H 2201/0184; A61H 2201/0176
See application file for complete search history.

(56) References Cited

U.S. PATENT DOCUMENTS

| | | | | |
|---|---|---|---|---|
| 8,808,205 | B2 * | 8/2014 | Freeman | A61H 31/00 601/41 |
| 9,700,482 | B2 * | 7/2017 | Walker | A61H 31/006 |
| 9,707,151 | B2 * | 7/2017 | Woerlee | A61H 31/00 |

FOREIGN PATENT DOCUMENTS

| | | |
|---|---|---|
| JP | H08-089482 | 4/1996 |
| WO | WO 2008/066455 | 6/2008 |
| WO | WO 2011/058001 | 5/2011 |
| WO | WO 2012/038855 | 3/2012 |
| WO | WO 2013/030700 | 3/2013 |
| WO | WO 2014/039383 | 3/2014 |

* cited by examiner

APPLIANCE FOR CARDIOPULMONARY MASSAGE AND/OR RESUSCITATION

The invention relates to an appliance for cardiopulmonary massage and/or resuscitation, comprising a massage device which can be driven reversibly in an actuation direction by a drive appliance and which comprises a pressure area which can be positioned on the ribcage of a patient at a target contact region.

Respiratory or circulatory arrest poses a severe risk to a patient's life. There is only any real chance of the patient surviving without long-term damage if "emergency circulation" by cardiopulmonary resuscitation is started successfully within a very short time, and maintained. Aside from ventilation, a central part of cardiopulmonary resuscitation involves carrying out cardiac massage to establish artificial blood-circulation, in such a way that vital organs such as in particular the brain are supplied with oxygen. Conventional cardiac massage is carried out manually, for example by a paramedic, who compresses and releases the patient's chest in the region of the sternum at frequencies of approximately 80-140 per minute, and thus brings about circulation of the blood through the patient's body and thus a supply of oxygen to the organs.

Manual chest compression for resuscitation is very strenuous for the helper carrying it out and can only be carried out at the required frequency for a limited time. Since it often also needs to be continued when the patient is being transferred to the hospital, mechanical appliances for cardiopulmonary massage have been proposed, which supplement the technical equipment of emergency vehicles, helicopters or the like and by means of which cardiac massage can be carried out on patients mechanically for virtually any desired time without the helpers becoming fatigued. Instead, they can be introducing additional life-saving measures while the mechanical appliance is carrying out the chest compression to maintain the emergency circulation. For this purpose, an appliance of this type comprises a massage device which can be driven by a drive and which is driven at the desired frequency, in other words reversing or up and down approximately 80-140 times a minute, and which comprises a pressure area, which is positioned on the patient's ribcage by the doctor or paramedic at the position provided for cardiac massage and can thus carry out the massage.

For cardiac massage to be carried out correctly, it is important to use the correct pressure point for this purpose and also to maintain it during the massage. The pressure point is located directly above the breastbone (sternum), more precisely at the upper end of the lower third of the sternum. The sternum is the best region for carrying out cardiac massage because the heart, which is the organ to be compressed, is located directly below it. Moreover, the breastbone is a solid bone, which is resiliently connected to the ribs by cartilage joints and can thus be moved. Deviating from the correct pressure point can lead not only to a reduction in the effectiveness of the cardiac massage, but to injuries to the patient, which are in some cases very severe and of which broken ribs are generally actually the least problematic. If during cardiac massage the pressure point is displaced towards the upper abdomen, this may result in severe injuries to the internal organs. It is therefore necessary, both during manual cardiopulmonary resuscitation and when it is carried out using a mechanical appliance, to keep checking the pressure point to prevent injuries of this type. However, whilst for manual cardiac massage this type of check is possible comparatively simply and after virtually every single compression process, if a mechanical cardiac massage device is used, which relieves the doctor or paramedic of this strenuous activity, it is easily possible for example for the massage device applied to the patient to be displaced laterally or up or down as a result of vibrations during the journey of the emergency vehicle, without the helper(s) noticing the resulting deviation in position of the contact surface relative to the target contact region, in other words relative to the upper region of the lower third of the sternum which defines the pressure point. For the known appliances, it is therefore necessary in all cases for a paramedic or the like to constantly check the correct position of the massage device and to correct it if applicable, but this makes it barely possible for said paramedic to initiate further life-sustaining or resuscitation measures during an emergency journey.

An object of the invention is to improve an appliance of the generic type in such a way that deviations of the pressure area of the massage device from a target pressure point are promptly and reliably established. This object is achieved by a position sensor device for detecting changes in the position of the massage device and/or the pressure area thereof relative to the target contact region on the patient's ribcage in a plane normal to the actuation direction of the massage device.

By means of the position sensor device, deviations in the position of the massage device or the pressure area thereof in a direction transverse to that of the up-and-down movement exerted thereby are thus detected automatically, meaning that for example if a particular threshold is exceeded the cardiac massage device can be stopped automatically or an alarm signal can be emitted, which alerts the paramedics that readjustment is required. The helpers can thus concentrate on further life-saving measures during the transportation of the patient, without having to monitor the cardiac massage device constantly themselves. In a preferred embodiment of the invention, the position sensor device is formed in such a way that it can be used to detect not only a displacement of the position in the substantially horizontal plane transverse to the movement direction of the massage device (X and Y axis), but also the present position of the massage device in the Z direction, in other words the movement direction thereof, including the upper and lower end-positions thereof. It is thus also possible to detect whether the upper and/or lower end-position of the massage device is possibly changing during the cardiopulmonary massage, this potentially occurring as a result of a fault in the operation, an incorrectly operating brake on the appliance, or—much more probably—a change in the position of the patient or another change in the patient's chest, which leads to a gap between the plunger and the breastbone when the highest position of the massage device is reached.

The position sensor device according to the invention is preferably arranged at least in part on the pressure area of the mounting appliance. The position sensor device may comprise a position sensor, which is arranged on the pressure area and which cooperates with a position marking means fastened to the target contact region on the patient's ribcage. Particularly preferably, a position marking means of this type comprises a preferably flexible holding layer, which can be detachably fixed to the patient's ribcage using an adhesive layer and on which a marking detectable by the position sensor and/or a pickup which acts on the position sensor is/are arranged. A position marking means of this type can be adhered to the desired point on the patient's ribcage rapidly and precisely by the doctor or paramedic, and thus mark the desired pressure point, which can subsequently be reliably monitored by the massage device by way of the cooperation of the position sensor with the marking or the pickup.

The position sensor device may operate according to an inductive, capacitive, magnetic and/or optical measurement method. It has been found to be particularly advantageous if the position sensor device has a capacitive sensor arrangement, the position sensor arranged on the pressure area comprising at least one, preferably a plurality of, sensor electrode(s) and the position marking means comprising at least one metal pickup element, the position sensor device comprising an evaluation device having means for detecting capacitance changes between the pickup element and the sensor electrode(s) and for determining the consequent changes in the relative position between the pressure area and the position marking means. In this context, the arrangement may be set up in such a way that the position sensor comprises a central sensor electrode and at least three, preferably four electrode segments arranged around the central sensor electrode. Using an arrangement of this type, it is possible to detect not only whether the position of the pressure area relative to the position marking means, and thus relative to the desired pressure point, has changed in a direction transverse to the actuation direction of the massage device, but also in what direction and to what extent a lateral displacement of this type has occurred. This is because in a lateral displacement of this type the capacitances measured between the metal pickup element on the position marking means and the central sensor electrode, and the electrode segments arranged around these, vary depending on the extent and direction of the displacement, and the measured changes can be unambiguously attributed to the individual electrodes or electrode segments. The cardiac massage device can thus for example advantageously be driven in such a way that, when the capacitance between at least one of the electrode segments arranged around the central sensor electrode and the metal pickup element on the position marking means changes, an optical and/or acoustic alert signal is emitted, which also becomes increasingly clearly perceptible, in other words brighter and/or louder, as the change in capacitance increases, and in such a way that, for a fixed change in the capacitance between the central sensor electrode and the metal pickup element, the drive appliance for the massage device is stopped, since this is a sign of an excessively large deviation of the position of the pressure area from the target position.

It has been found to be highly advantageous if a trigger element, preferably a trigger magnet, is arranged on the position marking means and cooperates with a proximity switch element arranged on the massage device to activate the position sensor device or the position sensor thereof. This embodiment means that the position sensor device of the massage device or the position sensor thereof does not have to be active constantly, this activity state naturally consuming energy (current), but instead the sensor device or position sensor is switched into the active state automatically, by means of the trigger element, if the massage device is applied after the position marking means has been attached to the patient's ribcage and the pressure area enters the proximity of the trigger element on the position marking means. The power consumption of the position sensor device can thus be kept to a minimum, specifically in that it is only activated when the massage device has been applied to the patient for the intended use.

As noted previously, alarm means and/or means for switching off the drive appliance may be provided, which are acted on by the position sensor device and which make the helpers aware of an undesired lateral displacement of the apparatus relative to the best pressure point for cardiac massage and/or automatically power-off the appliance if a maximum acceptable shift of the appliance is exceeded, so as reliably to prevent injury to the organs in the patient's upper abdomen for example.

In an advantageous development of the invention, the position sensor device further comprises means for radio communication of position data, detected by the position sensor and optionally pre-processed by an evaluation device, to a monitoring unit. The arrangement may be set up in such a way that the means for radio communication comprise a radio transmitter, which is arranged on the massage device near the pressure area and which can be activated by the trigger element provided on the position marking means. In this way, it is possible also for the means for radio communication to be activated only when the entire appliance is applied to the patient in a provided orientation, since in this case the radio sensor enters the proximity of the trigger element, causing it to be activated. Radio communication of the position data prevents the difficulties of data transmission along the massage plunger, which is constantly moving back and forth, during operation of the appliance.

It is possible to use the position data detected by the position sensor not only to emit an alarm signal or stop the drive of the massage device if the position deviates from a target position, but also, by means of the position data, active position regulation of the massage device transverse to the actuation direction thereof can be implemented. For this purpose, in a particularly advantageous development of the invention, the appliance according to the invention comprises an actuating drive, which adjusts the massage device or the pressure area thereof in the plane normal to the actuation direction and by means of which the position changes detected by the position sensor can be compensated. It goes without saying that in this case the actuating drive is only activated when the appliance is not currently in a compression state, in other words the pressure area of the massage device is unloaded and preferably raised some distance away from the patient's body.

In the appliance according to the invention, the massage device may comprise a massage plunger, which is preferably arranged so as to be replaceable. As a result, it is possible to use massage plungers having pressure areas of different sizes, so as to take into account different body sizes of the patients to be treated or other influencing variables. Thus, naturally, a plunger having a larger pressure area is preferred for cardiac massage on an adult male, and a plunger having a smaller pressure area is preferably used for treating an infant. According to the invention, in a particularly advantageous embodiment the various plungers may be provided with a signal generator or transponder which distinguishes the respective plunger size and/or the preferred field of application thereof and which communicates these data distinguishing the respective plunger to the monitoring unit preferably via the radio link when the massage plunger is inserted into the apparatus. The monitoring unit thus automatically detects which plunger is inserted into the apparatus, and on the basis of this information can implement the preferred basic settings for the relevant plunger, such as massage frequency or massage depth (stroke of the plunger during cardiac massage). It goes without saying that these basic settings can be adapted by the paramedic or doctor as required, in a manner tailored to the individual patient.

Further features and advantages of the invention can be found in the following description and the drawings, which describe and illustrate a preferred embodiment of the invention in greater detail by means of an example. In the drawings.

Figure 1:
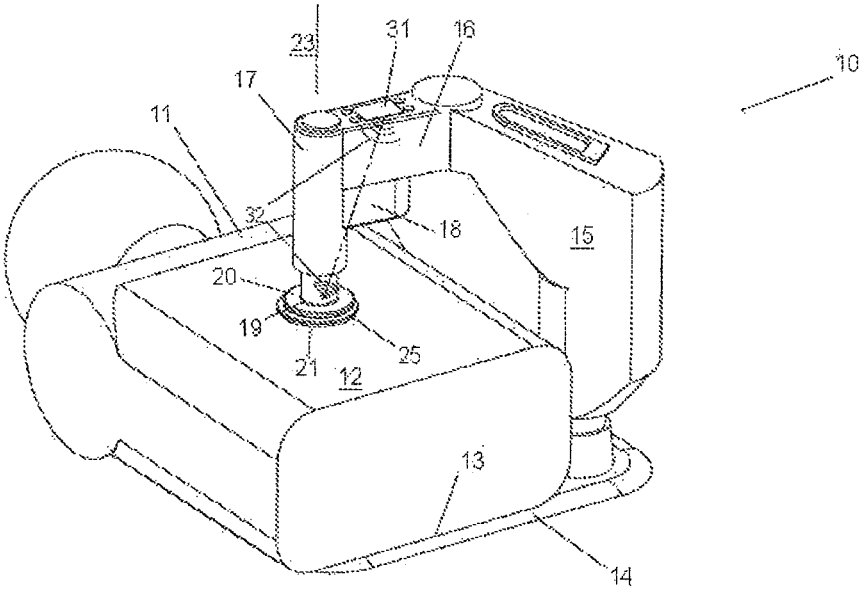
FIG. 1 is a perspective drawing from diagonally above of an appliance for cardiopulmonary massage according to the invention applied to a patient's chest.
Figure 2:
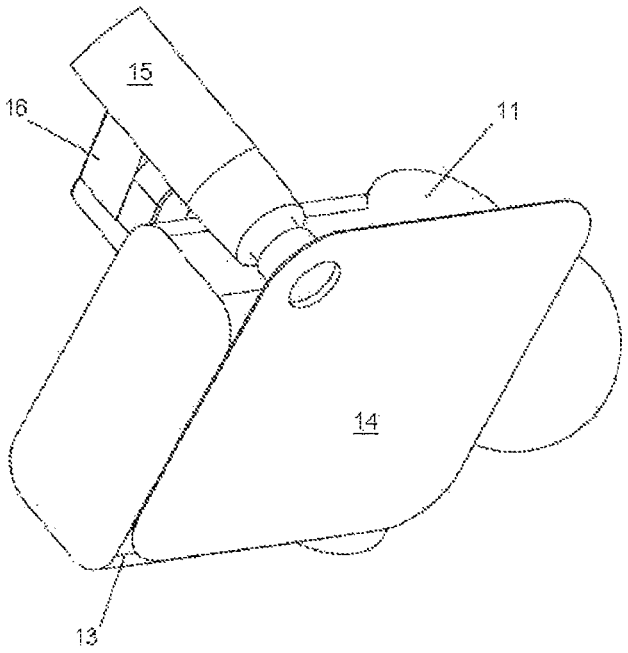
FIG. 2 is a perspective drawing from diagonally below of the subject matter of FIG. 1.
Figure 3:
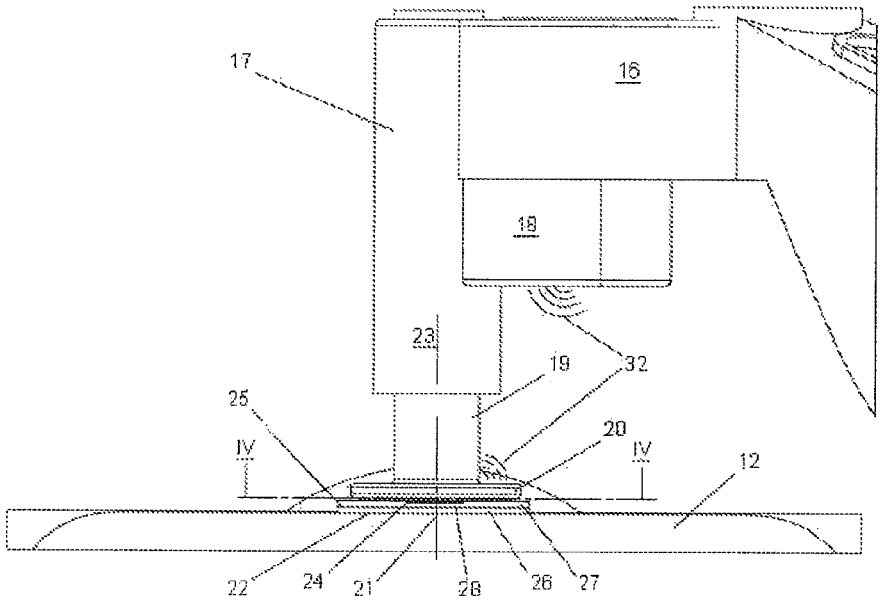
FIG. 3 is an elevation of the massage device, applied to the patient, of the appliance according to the invention.

FIGS. 1 and 2 show an appliance, denoted as a whole by 10, for cardiopulmonary massage and/or resuscitation of a patient 11 in the position thereof on the chest 12 of said patient. The appliance 10 comprises a counter-bearing board 14, which is placed underneath the back 13 of the patient 11 and in one corner region of which an upwardly projecting portal support 15 is arranged. The portal support 15 is arranged so as to be pivotable about a vertical axis and vertically displaceable relative to the counter-bearing board 14. It can be locked in various vertical positions, preferably continuously. At the upper end thereof, it carries an arm 16, which is likewise mounted on the portal support 15 so as to be articulated about a vertical axis. In turn the arm 16 is provided on the outer, free end thereof with a massage device 17, which is driven reversibly up and down in a substantially vertical direction by a drive device 18 arranged in the interior of the arm housing. The massage device 17 is shown in greater detail in FIG. 3.

The massage device 17 has a massage plunger 19 (Gellert: not provided with a number in FIG. 1—please add this in) comprising a lower pressure area 20 which, when the appliance is used as intended, is positioned on the ribcage 12 of the patient 11 at a target contact region 21—specifically normally at the upper end of the lower third of the sternum—and carries out cardiopulmonary massage on the patient during the operation of the massage device in that the massage plunger 19 which moves up and down compresses and releases the ribcage 12 at the set frequency.

It is important that during this cardiopulmonary massage the target contact region or pressure point 21 at which the pressure area 20 of the massage plunger 19 acts does not change, or at least not significantly. To provide these even for example during transportation of the patient, according to the invention a position sensor device, denoted as a whole by 22, is provided, and serves to detect changes in the position of the massage device or of the pressure area 20 of the massage plunger 19 thereof relative to the target contact region 21 on the chest 12 of the patient 11 in a plane normal to the actuation direction 23 of the massage device 17. This position sensor device 22 basically consists of two components, specifically a position sensor 24 arranged on the pressure area 20 of the massage plunger 19 and a position marking means 25 which is fastened to the target contact region 21 on the patient's ribcage and with which the position sensor (24) cooperates. In the preferred embodiment shown, the position marking means 25 is adhered to the chest 12 of the patient above the target contact region 21 in the manner of a large plaster. For this purpose, it comprises a flexible holding layer 27, which is provided with an adhesive layer 26 and in the interior of which a pickup 28 is arranged, which acts on the position sensor 24 and consists of a round piece of thin metal film.

Figure 4:
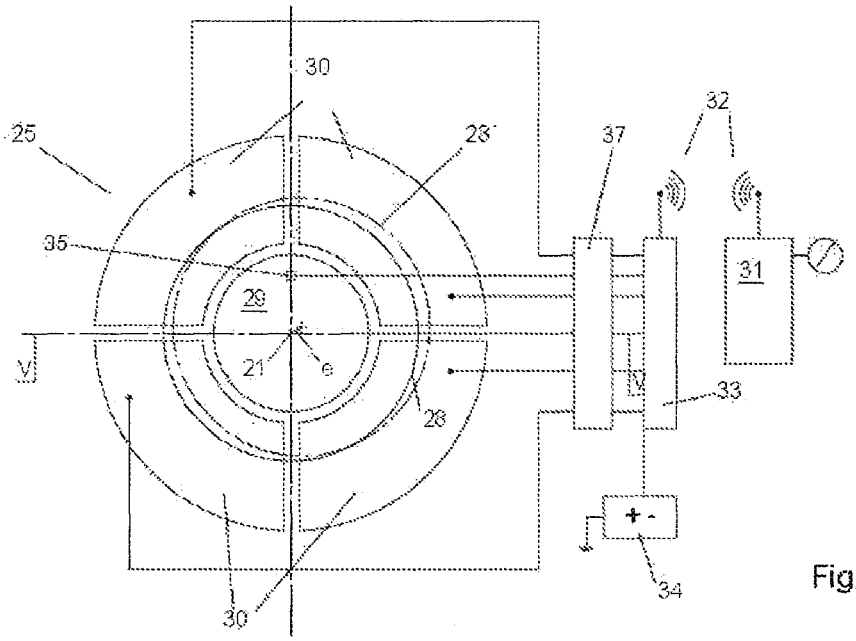
FIG. 4 is a schematic horizontal section, along the line IV-IV in FIG. 3, of the position sensor device of the appliance according to the invention together with an evaluation device assigned thereto.
Figure 5:
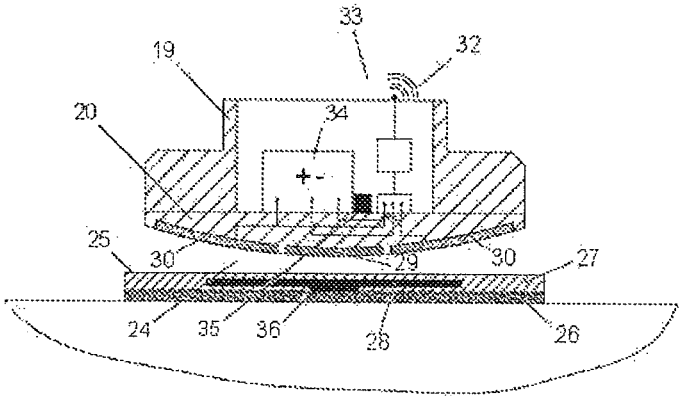
FIG. 5 is a section, along the line V-V, of the subject matter of FIG. 4.

In the shown and described preferred embodiment of the invention, a capacitive measurement method is used for monitoring the position of the massage device. Accordingly, the position sensor device has a capacitive sensor arrangement in which the position sensor 24 arranged on the pressure area 20 of the massage plunger 19 has a total of five sensor electrodes in the form of conductive metal plates or films, specifically a central sensor electrode 29 and four electrode segments 30 extending around the central sensor electrode (Gellert: FIG. 4 bottom right sensor surface is not labelled with "30"; please add this in!), which are in the form of annular ring segments and each extend over an angular range of 90° (FIG. 4). As can also be seen in FIG. 4, the pickup 28 arranged on the position marking means 25 has a greater diameter than the central sensor electrode 29. If the pickup and the central sensor electrode are arranged so as to be mutually coaxial, the peripheral edge of the pickup 28 (continuous line in FIG. 4) is also positioned uniformly under all four electrode segments 30, in each case approximately ⅓ of the area of each of the outer sensor elements 30 in the form of an annular ring segment being covered by the metal film of the pickup element 28.

The pickup element arranged on the position marking means 25 and the sensor electrodes 29, 30 located above and provided on the pressure area 20 of the massage plunger 19 form the plates of a total of five plate capacitors, the capacitance of which is dependent on the size of the area by which the electrodes 29, 30 cover the pickup element 28 in each case. A lateral displacement e of the pressure area 20, together with the sensor electrodes 29, 30 arranged thereon, relative to the position marking means attached to the patient, together with the pickup element 28 arranged therein, always results in a change in the capacitance between the pickup element 28 and the outer electrodes 30 in the form of annular ring segments, since in this case the effective areas between the pickup element and the electrode segments are changed. This is illustrated in FIG. 4 by the dashed representation 28' of the pickup element displaced by the amount e from the central target position of the pickup element 28. The respective present values of the capacitors of the five (plate) capacitors are determined by means of an evaluation device 27 and communicated from a transmitter 33 via a radio link 32 to a monitoring unit 31, which in the embodiment shown is located so as to be easily accessible on top of the arm 16 (FIG. 1). From the type of capacitance change (increase or decrease in the effective area) and the finding as to the extent to which the changes are detected at each of the four electrode segments, the monitoring unit 31 (merely shown schematically in FIG. 4) can detect not only the magnitude but also the direction of the lateral displacement.

Once the monitoring unit 31 establishes a lateral displacement e of the massage plunger relative to the position marking means which is larger than a set threshold, it emits an optical or acoustic warning signal, which gives an alert as to the displacement. Once the monitoring unit 31 also establishes a change in capacitance between the central sensor electrode 29 and the pickup element 28, the drive device 18 for the massage plunger 19 is stopped, since the change in capacitance between the central sensor electrode in the pickup element is a sign that the lateral displacement has reached a value at which risk-free continuation of the massage is no longer ensured.

For transmitting the capacitance values determined by the evaluation device 37, which result from the active areas between the electrodes and the pickup element, via the radio link 32, a radio transmitter 33 is provided on the massage plunger 19 just above the pressure area 20, and in the preferred embodiment shown obtains the power supply thereof from a battery 23 likewise arranged on the massage plunger. This battery also provides the current required for the evaluation device 37. The radio transmitter 33 is activated by a proximity switch 35, which is triggered by a trigger magnet 36, arranged below the pickup element 28 on the position marking means 25, when the massage plunger 19 enters the vicinity of the position marking means and the proximity switch 35 thus enters the action range of the trigger magnet 36. The current supply of the evaluation device 37 and the radio link 33 is thus generated automatically by the battery 34, and only when the device is actually applied to patients for use. This therefore ensures that the evaluation device and the radio link 33 are only activated when the pressure area 20 of the massage device 17 is located above the position marking means 25 applied to the chest of the patient. Thus, when the appliance is not in use, the evaluation device 37 and the radio link 33 are not active and thus do not consume any current from the battery.

The invention is not limited to the embodiments described and shown thus far, but rather various alterations and additions are conceivable without departing from the scope of the invention. Thus, it is possible for example to use an inductive, magnetic or optical measurement method instead of a capacitive measurement system. If an optical measurement method is used, in which for example a reflected-light barrier is used, the differences in the light reflection between bright and dark surfaces of a position marking are established, and a conclusion is thus reached as to the extent and direction of a lateral migration of the massage plunger from the desired pressure point. If an optical method of this type is used, the position marking means may in the simplest case be a marking, for example a cross, made in the region of the pressure point on the patient's ribcage using a pen, for example a fibre-tip pen.

If an inductive measurement method is to be used, this may be implemented in such a way that a resonator circuit actuated by the evaluation device is provided in the base of the massage plunger, and cooperates with a coil or metal surface accommodated on the position marking means and changes amplitude or frequency when the massage plunder changes lateral position relative to the position marking means. For a magnetic measurement method, a thin magnet is arranged in the position marking means and is measured by a Hall element arranged in the base of the massage plunger. In this case, a fall in the measured field strength is a sign of a lateral displacement of the massage plunger from the target position.

The invention is also suitable for active position regulation of the massage device in that if a lateral displacement from the target position is detected the massage device is repositioned and thus brought back into the target position. For this purpose, adjusting motors (not shown) which act between the counter-bearing board 14 and portal support 15 on the one hand and the portal support 15 and arm 16 on the other hand may be provided, and adjust the portal support and the arm, in each case as a function of the position data communicated by the position sensor device on the monitoring unit, and thus bring the massage plunger 19 back into the desired position thereof coaxial with respect to the position marking means. In this context, the (small) adjustment movements of the adjusting motors occur (only) when the massage plunger 19 is located in the raised position thereof, in other words is raised some distance from the patient's chest 12 and is not currently in physical contact with the position marking means 25.

The invention claimed is:

1. An appliance for cardiopulmonary massage and/or resuscitation, comprising a massage device which can be driven reversibly in an actuation direction by a drive appliance and which comprises a pressure area which can be positioned on the ribcage of a patient at a target contact region, further comprising a position sensor device configured to detect changes in the position of the massage device and/or the pressure area thereof relative to the target contact region on the patient's ribcage in a plane normal to the actuation direction of the massage device, wherein the position sensor device operates according to an inductive, capacitive, and/or magnetic measurement method, and wherein the position sensor device comprises a radio link configured to provide radio communication of position data, detected by the position sensor or the evaluation device, to a monitoring unit.

2. The appliance according to claim 1, wherein the radio link comprises a radio transmitter which is arranged on the massage device near the pressure area and which can be activated by the trigger element provided on the position marker.

3. The appliance according to claim 1, wherein the position sensor device is arranged at least in part on the pressure area of the mounting appliance.

4. The appliance according to claim 1, wherein the position sensor device comprises a position sensor, which is arranged on the pressure area and which cooperates with a position marker fastened to the target contact region on the ribcage of the patient.

5. The appliance according to claim 4, wherein the position marker comprises a preferably flexible holding layer, which can be detachably fixed to the ribcage of the patient using an adhesive layer and on which a marking detectable by the position sensor or a pickup which acts on the position sensor is arranged.

6. The appliance according to claim 4, wherein the position sensor device has a capacitive sensor arrangement, the position sensor arranged on the pressure area comprising at least one sensor electrode and the position marker comprising at least one metal pickup element, the position sensor device comprising an evaluation device and/or a monitoring unit having a detector configured to detect capacitance changes between the pickup element and the at least one sensor electrode and to determine the consequent changes in the relative position between the pressure area and the position marker.

7. The appliance according to claim 6, wherein the position sensor comprises a central sensor electrode and at least three electrode segments arranged around the central sensor electrode.

8. The appliance according to claim 4, wherein a trigger element, preferably a trigger magnet, is arranged on the position marker and cooperates with a proximity switch element arranged on the massage device to activate the position sensor device or the position sensor thereof.

9. The appliance according to claim 1, further comprising an alarm and/or a switch configured to switch off the drive device, which are acted on by the position sensor device.

* * * * *